US005085239A

United States Patent [19]

Chin-Hung et al.

[11] Patent Number: 5,085,239

[45] Date of Patent: Feb. 4, 1992

[54] STRUCTURE OF SAFETY UMBRELLA

[76] Inventors: Teng Chin-Hung, No. 12, Alley 2, Lane 186, Sec. 2, San Ming Rd., Panchiao City, Taipei Hsien; Lin-chang Zon, No. 117, Sec. 2, Chung Shan Rd., Kuang Fu Hsian, Hua Lien Hsien; Frank Yu, No. 25, Lih Hsing La., Lih Hsing St., I Lan City, I Lan Hsien, all of Taiwan

[21] Appl. No.: 650,854

[22] Filed: Feb. 5, 1991

[51] Int. Cl.[5] ..... A45B 19/00

[52] U.S. Cl. ..... 135/25.33; 135/28; 135/31; 135/33.41

[58] Field of Search ..... 135/28-31, 135/33.41, 22, 23, 25.33, 33.2, 33.6

[56] References Cited

U.S. PATENT DOCUMENTS

| | | | |
|---|---|---|---|
| 886,426 | 5/1908 | Shivers | 135/33.41 X |
| 1,006,240 | 10/1911 | Lewis | 135/33.41 X |
| 1,082,645 | 12/1913 | Myers | 135/33.41 |
| 3,252,468 | 5/1966 | Militano | 135/29 X |
| 3,643,673 | 2/1972 | Weber | 135/28 X |
| 4,368,749 | 1/1983 | Lindler et al. | 135/28 X |
| 4,823,821 | 4/1989 | Day | 135/22 X |

FOREIGN PATENT DOCUMENTS

| | | | |
|---|---|---|---|
| 265924 | 7/1929 | Italy | 135/33.41 |
| 132464 | 6/1929 | Switzerland | 135/30 |
| 479272 | 11/1969 | Switzerland | 135/28 |

*Primary Examiner*—David A. Scherbel
*Assistant Examiner*—Lan Mai
*Attorney, Agent, or Firm*—Morton J. Rosenberg; David I. Klein

[57] ABSTRACT

An umbrella, having a cover stretched over a plastic folding radial frame which comprises upper, intermediate and lower nest plates respectively mounted on a main shaft for securing a plurality of ribs. The nest plates are identical in structure, each comprised an upper circular member having a plurality of pawls and retaining holes at the bottom respectively engaged with a plurality of retaining holes and pawls on the top of a lower circular member for securing the ribs. The cover comprises a plurality of fastening caps at the corners around its periphery and a plurality of snap fastening elements on each radial line thereof for securing the ribs. Because all the parts are made of plastic material, the umbrella is not electrically conductive and can protect against lightning.

1 Claim, 7 Drawing Sheets

STRUCTURE OF SAFETY UMBRELLA

BACKGROUND OF THE INVENTION

The present invention is related to umbrellas, and more particularly to an umbrella all the parts of which are completely made of plastic material and can be conveniently set up by a non-skilled people.

The folding radial frame of a regular umbrella is generally made of metal material which is complicated and expensive to manufacture or assemble. Because metal material is electrically conductive, it is dangerous to hold an umbrella of metal folding radial frame under the flash of lightning. The present invention has been accomplished to eliminate the these problems.

BRIEF DESCRIPTION OF THE DRAWINGS

The present invention will now be described by way of example with reference to the annexed drawings, in which.

DETAILED DESCRIPTION OF THE PREFERRED EMBODIMENT

Figure 1:
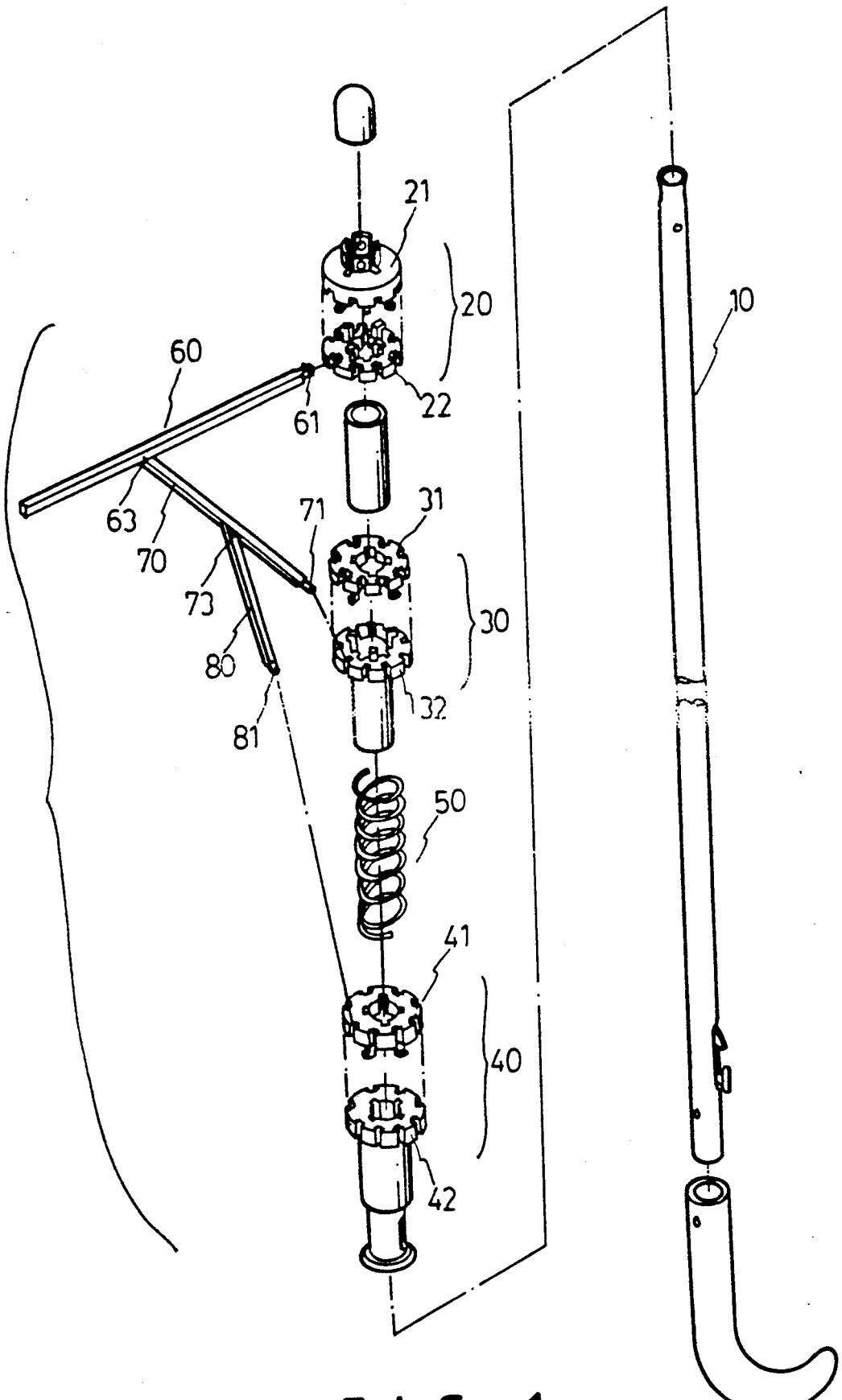
FIG. 1 is a partly perspective dismantled view of a folding radial frame according to the present invention.
Figure 2:
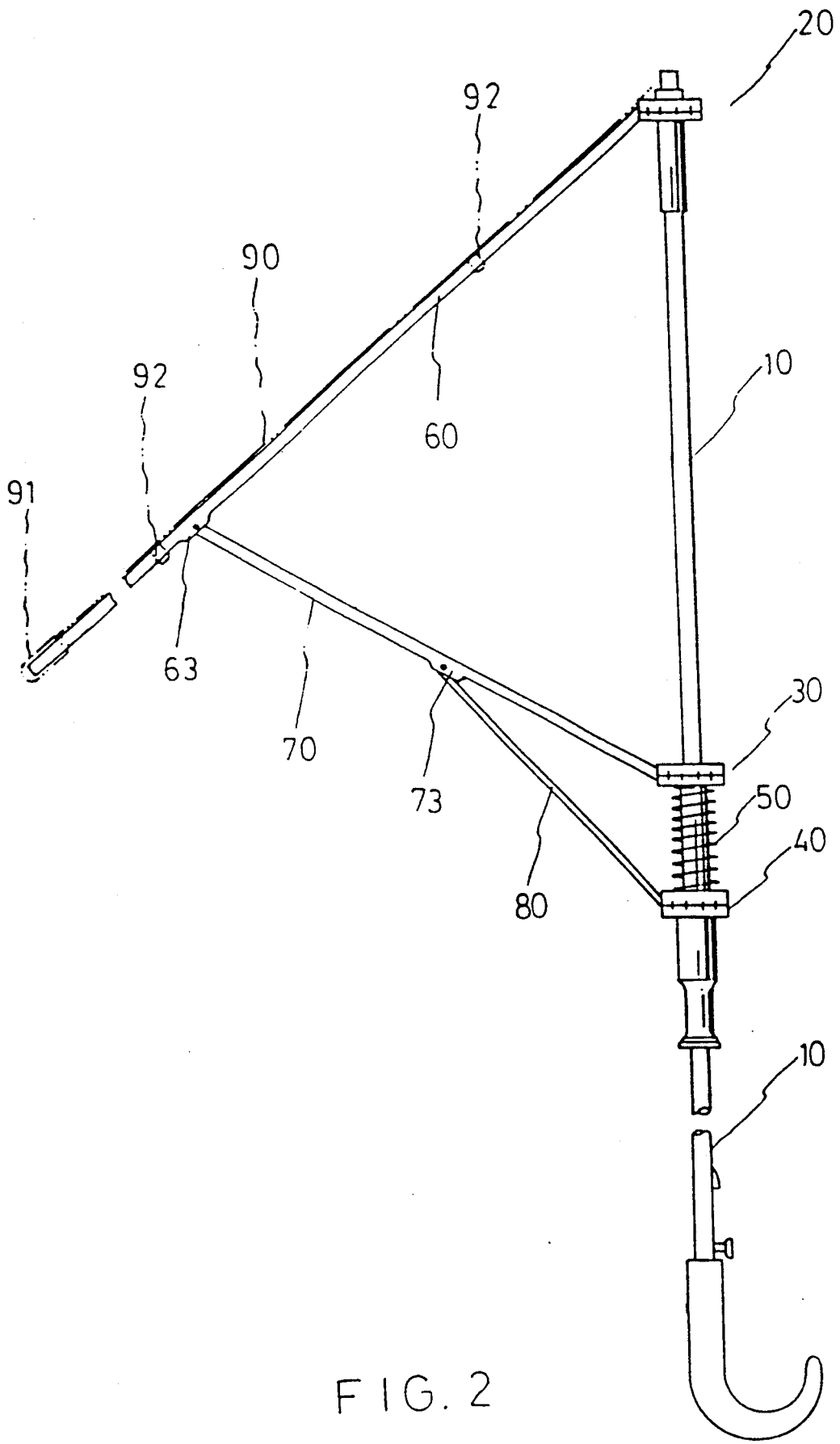
FIG. 2 is a partly perspective assembly view of the folding radial frame of FIG. 1.

Referring to FIGS. 1 and 2, the parts of the folding radial frame of an umbrella in accordance with the present invention can be conveniently connected into shape without the use of rivets or iron wires which are generally used in conventional umbrella manufacturing process for connecting the ribs together or for securing the ribs to the nest plates. According to the present invention all the parts of an umbrella are made of plastic material. As illustrated, the upper nest plate 20, the intermediate nest plate 30 and the lower nest plate 40 are identical in structure and each comprised of two circular members connected together. The main ribs 60, the auxiliary ribs 70 and the supporting ribs 80 have each a projecting portion 61, 71 or 81 at one end and directly fastened in the upper, intermediate and lower nest plates 20, 30, 40 respectively. The auxiliary ribs 70 and the supporting ribs 80 have each another projecting portion at the opposite end respectively fastened in the flanges 63 or 73 at the middle of the main ribs 60 or the auxiliary ribs 70. After the ribs 60, 70, 80 are respectively connected together and fastened in the nest plates 20, 30, 40, the nest plates 20, 30, 40 are then respectively sleeved on the main shaft 10 with the upper nest plate 20 fixedly set at the top by means of a lock pin.

Figure 7:
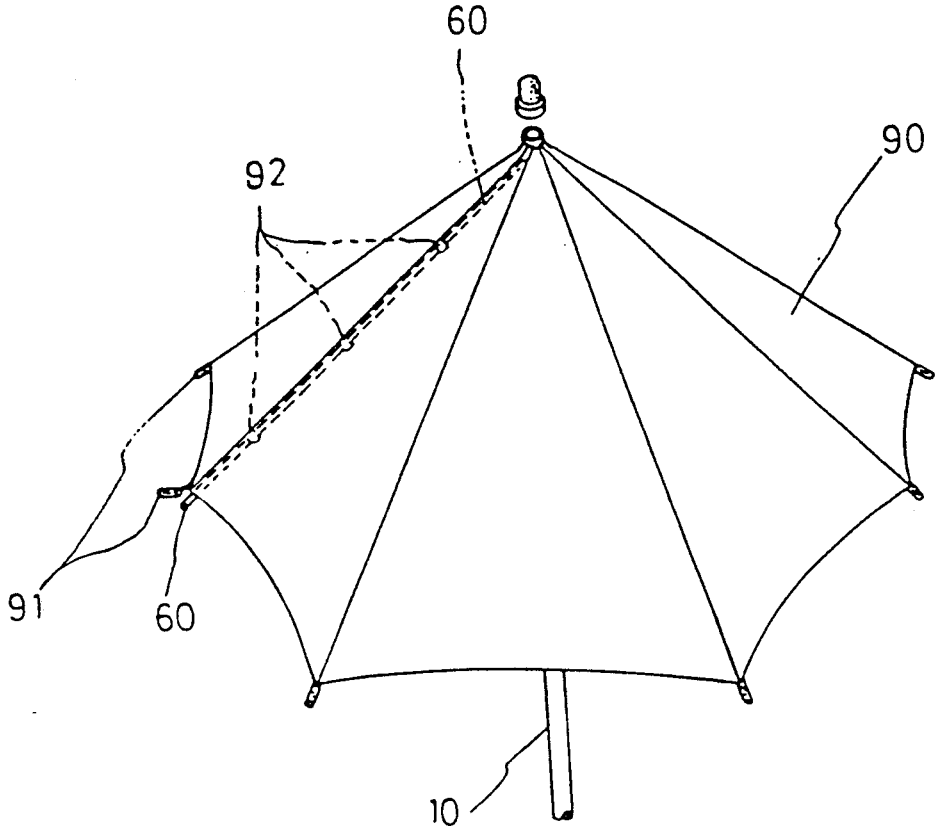
FIG. 7 illustrates the structure of the umbrella cover mounted on the folding radial frame of the present invention.
Figure 8:
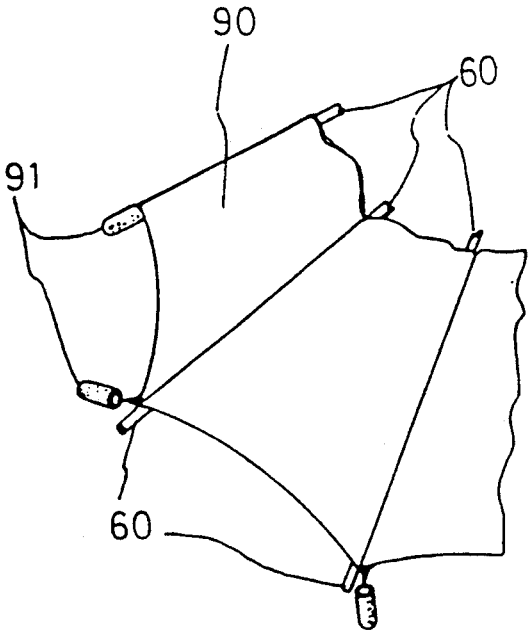
FIG. 8 illustrates the connection of the fastening caps with the main ribs.
Figure 9:
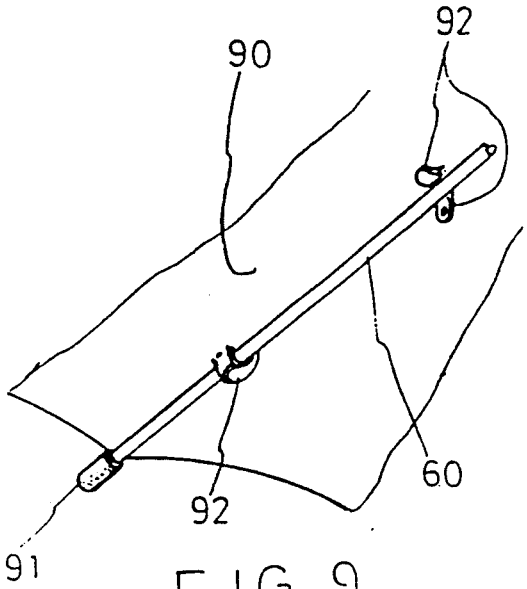
FIG. 9 illustrates the connection of the snap fastening elements with the main ribs.

Referring to FIGS. 7 through 9, the umbrella cover 90 is stretched over the folding radial frame for protection against the rain or sun. The umbrella cover 90 has a hole at the center for insertion therein of the main shaft 10 to match with a hoop, a plurality of fastening caps 91 at the corners thereof for connecting the ends of the main ribs 60, and a plurality of snap fastening elements 90 at each radial line thereof for securing to the main ribs 60. Therefore, the umbrella cover 90 can be conveniently replaced with a new one of a desired pattern design.

Figure 3:
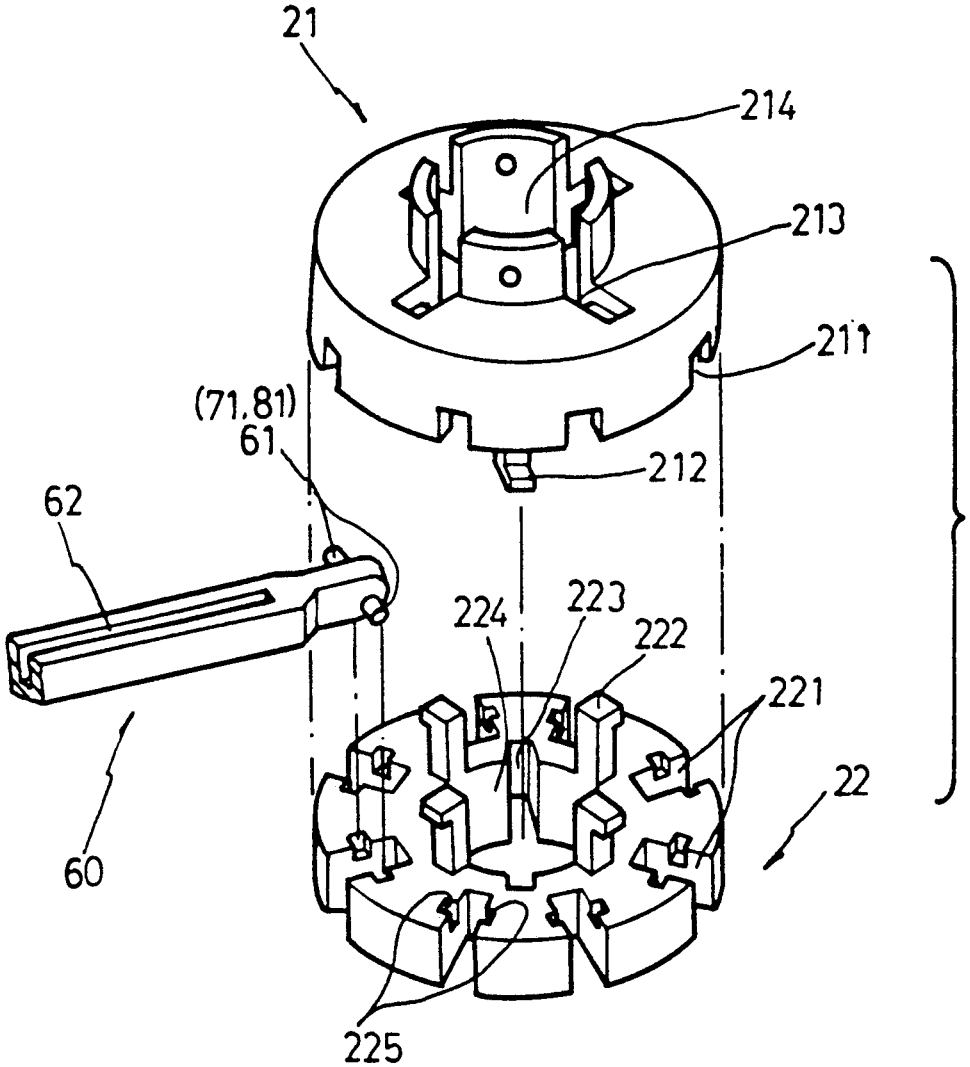
FIG. 3 illustrates the structure of the nest plates according to the present invention.
Figure 3A:
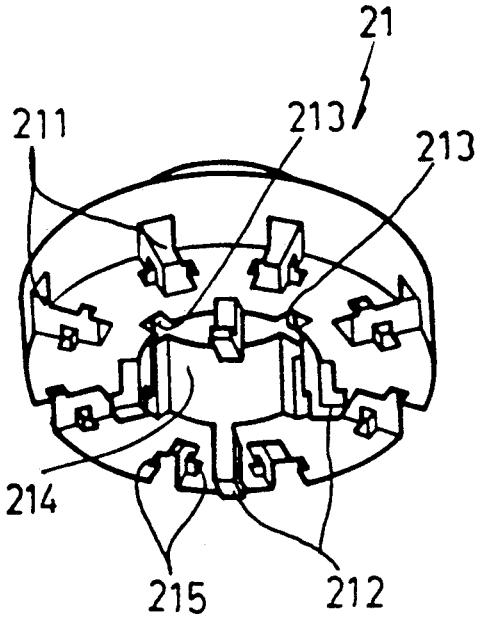
FIG. 3A is a perspective view of an upper circular member of the nest plate.

Referring to FIG. 3, the upper, intermediate and lower nest plates 20, 30, 40 are identical in structure. Therefore, the upper nest plate 20 is described hereinafter as an example for understanding of the structure. As illustrated, the upper nest plate 20 is comprised of an upper circular member 21 and a lower circular member 22 connected together. The upper circular member 21 comprises a plurality of pawls 212 and retaining holes 213 symmetrically made at the bottom around its axle hole 214 which is made at the center, and a plurality of notches 211 equidistantly made around its periphery for mounting the ribs, which notches 211 have each a crossed retaining groove 215 extending therefrom at two opposite sides. The lower circular member 22 has a plurality of pawls 222 and retaining holes 223 at the top around its axle hole 224 and corresponding to the pawls 212 and retaining holes 213 of the upper circular member 21, and a plurality of openings 221 around its periphery and corresponding to the notches 211 of the upper circular member 21, which openings 221 have each a crossed retaining groove 225 extending therefrom at two opposite sides and corresponding to the crossed retaining groove 215 of the upper circular member 21. The main ribs 60 have each two opposite dowels 61 at its projecting portion. During assembly, the main ribs 60 are respectively inserted in the openings 221 of the circular member 22 with the dowels 61 thereof seated in the retaining grooves 225, and then, the upper circular member 21 is attached to the lower circular member 22 with its pawls 212 and retaining holes 213 respectively engaged with the retaining holes 223 and pawls 222 of the lower circular member 22, permitting the main ribs 60 to movably secured in the notches 211 and the openings 221.

Figure 4A:
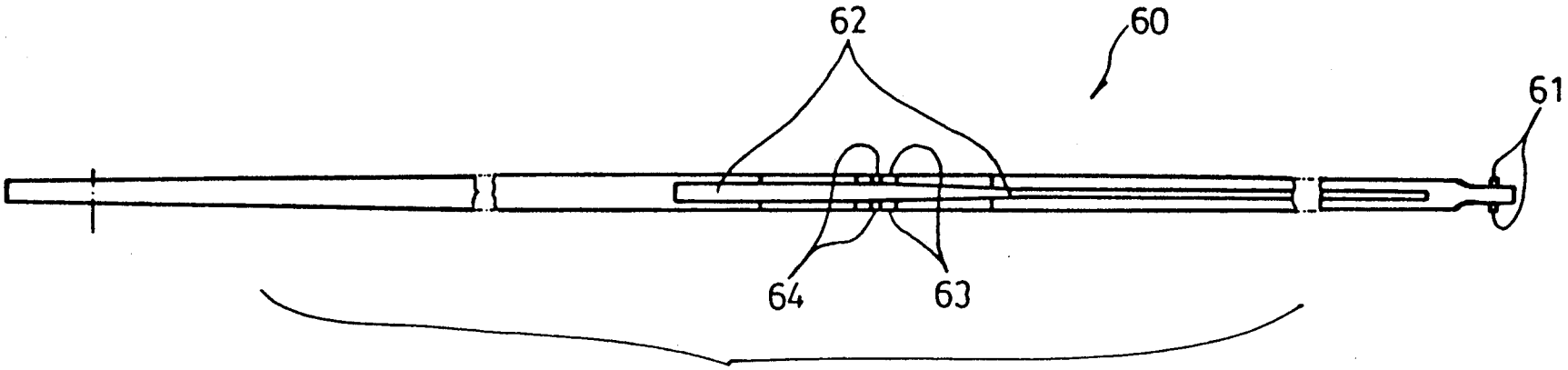
FIGS. 4A and 4B illustrate the structure of the main ribs according to the present invention.
Figure 4B:
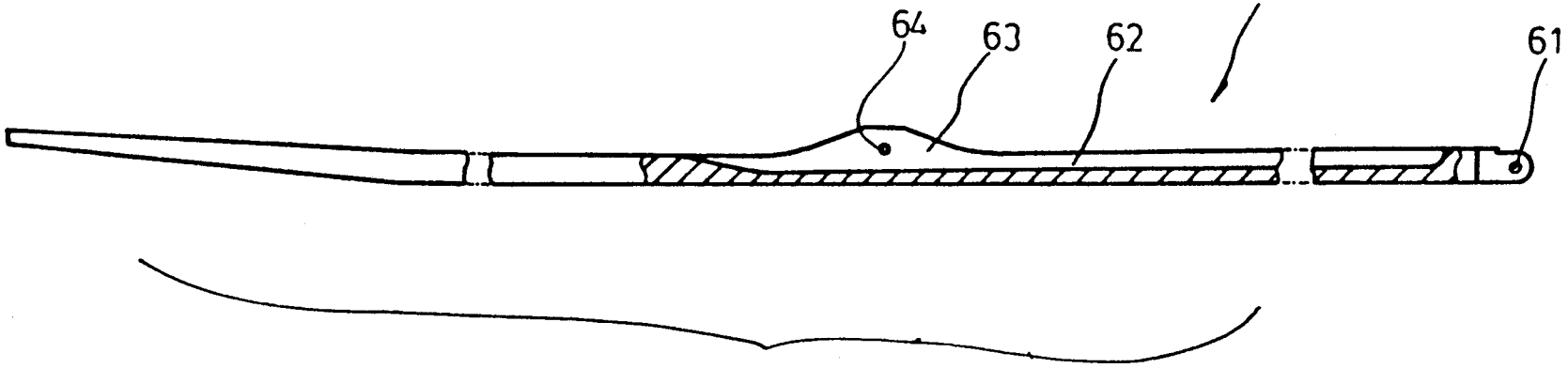
Figure 5:
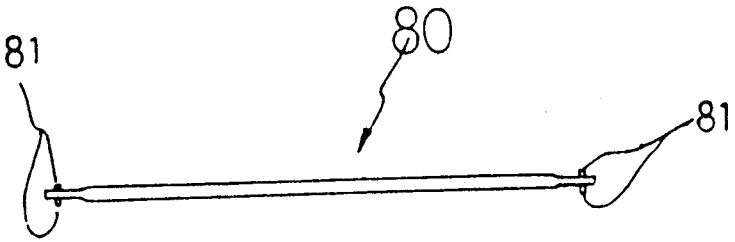
FIG. 5 illustrates the structure of the supporting ribs according to the present invention.
Figure 6A:
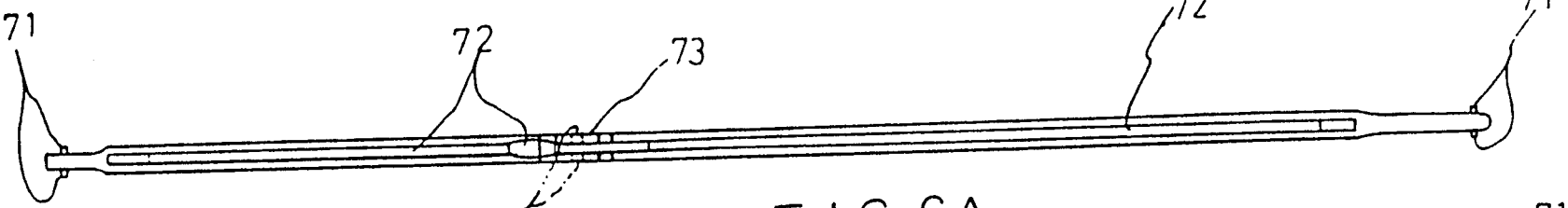
FIGS. 6A and 6B illustrate the structure of the auxiliary ribs according to the present invention.
Figure 6B:
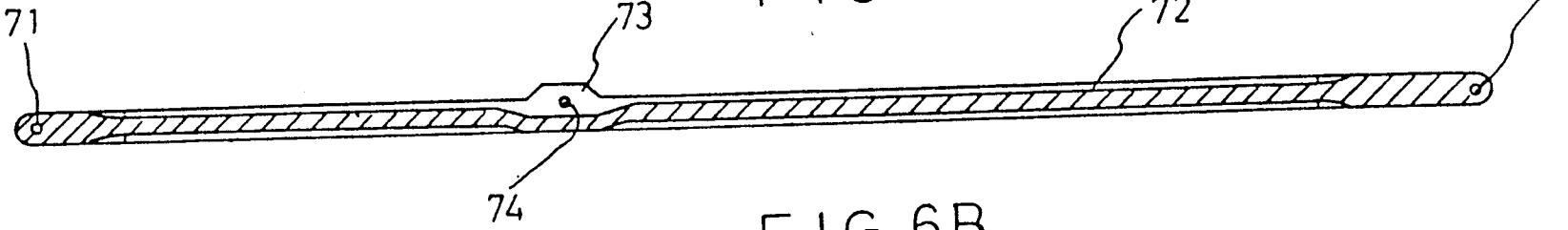

Referring to FIGS. 4 through 6, the main ribs 60 which are relatively longer have each two opposite dowels 61 bilaterally extending outward from the flat projecting portion 61 at its one end, and an elongated sloping groove 62 made at the bottom at a suitable location and gradually reduced to the end, which sloping groove 62 comprises two unitary flanges 63 bilaterally disposed at its wider entrance with a small hole 64 each made thereon. The auxiliary ribs 70 also have each two opposite dowels 71 bilaterally respectively extending outward from each of the two flat projecting portions at its two opposite ends, and an elongated sloping groove 72 at the bottom which comprises two unitary flanges 73 bilaterally disposed at its wider entrance with a small hole 74 each made thereon. The supporting ribs 80 which are relatively shorter have each two opposite dowels 81 bilaterally respectively extending outward from each of the two flat projecting portions at its two opposite ends. When an auxiliary rib 70 is inserted with its one end from the wider entrance into the elongated sloping groove 62 of a corresponding main rib 60, the two opposite flanges 63 of such a main rib 60 are forced to expand outward, because of its elastic material property, permitting the two dowels 71 of the auxiliary rib 70 at the end which is inserted in the corresponding main rib 60 to respectively insert in the small holes 64 of the two opposite flanges 63. Therefore, the auxiliary ribs 70 can be pivotably secured to the main ribs 60. By means of the same arrangement, the supporting ribs 80 can be respectively pivotably secured to the auxiliary ribs 70 with the dowels 81 at the ends which are respectively inserted in the auxiliary ribs 70 respectively inserted in the small holes 74 on the flanges 73 of the auxiliary ribs 70. Therefore, the supporting ribs 80 can also be pivotably respectively secured to the auxiliary ribs 70.

What is claimed is:

1. An umbrella comprising an umbrella cover stretched over a plastic folding radial frame, said plastic folding radial frame being comprised of a main shaft with an upper nest plate fixedly secured thereto at the top, an intermediate nest plate movably mounted thereon at the middle and a lower nest plate movably mounted thereon at a lower position, a plurality of main ribs having each an end fastened in said upper nest plate for securing said umbrella cover, a plurality of auxiliary ribs having each an end pivotably fastened in said main ribs and an opposite end pivotably fastened in said intermediate nest plate, and a plurality of supporting ribs having each an end pivotably fastened in said auxiliary ribs and an opposite end pivotably fastened in said lower nest plate, and characterized in that:

said upper, intermediate and lower nest plates are identical in structure and each comprised of an upper circular member connected with a lower circular member, said upper circular member comprising a plurality of pawls and retaining holes symmetrically made at the bottom around an axle hole made at the center thereof, and a plurality of notches equidistantly made around its periphery, said notches having each a crossed retaining groove extending therefrom at two opposite sides, said lower circular member having a plurality of pawls and retaining holes at the top around an axle hole at the center thereof for connection with the pawls and retaining holes of said upper circular member respectively, and a plurality of openings around its periphery corresponding to the notches of said upper circular member, said openings having each a crossed retaining groove extending therefrom at two opposite sides and corresponding to the crossed retaining groove of said upper circular member;

said main ribs being relatively longer than said auxiliary ribs and said supporting ribs, having a flat projecting portion at its one end with two opposite dowels bilaterally extending outward therefrom, and an elongated sloping groove at its bottom and gradually reduced from a wider entrance, and two unitary flanges bilaterally disposed at said wider entrance with a small hole each made thereon;

said auxiliary ribs having each two opposite dowels bilaterally respectively extending outward from each of the two flat projecting portions at the two opposite ends thereof, an elongated sloping groove at the bottom, and two unitary flanges bilaterally disposed at the middle of the elongated sloping groove thereof with a small hole each made thereon;

said supporting ribs being relatively shorter, having each two opposite dowels bilaterally respectively extending outward from each of the two flat projecting portions at the two opposite ends thereof for connection to the flanges of said auxiliary ribs and said lower nest plate;

said umbrella cover being made in shape for stretching over said folding radial frame, having a plurality of corners around its periphery, a fastening cap each at said corners for securing the opposite end of said main ribs, and a plurality of snap fastening elements on each radial line thereof for securing said main ribs to the umbrella cover.

* * * * *